US005135424A

United States Patent [19]

Holliday et al.

[11] Patent Number: 5,135,424

[45] Date of Patent: Aug. 4, 1992

[54] THROWING TOY

[76] Inventors: Charles O. Holliday, P.O. Box 234, Williamston, S.C. 29697; Bobby J. Holliday, 110 Holliday St., Pelzer, S.C. 99669

[21] Appl. No.: 745,145

[22] Filed: Aug. 15, 1991

[51] Int. Cl.[5] ..... A63H 27/00

[52] U.S. Cl. ..... 446/61; 446/28

[58] Field of Search ..... 446/34, 61, 26, 28; 24/545, 562, 3 K; 273/424, 425

[56] References Cited

U.S. PATENT DOCUMENTS

| | | | |
|---|---|---|---|
| 200,299 | 2/1878 | Hotchkiss | 24/545 |
| 1,392,715 | 10/1921 | Sommer | 24/3 K |
| 2,925,276 | 2/1960 | Leclerc | 273/428 |
| 3,264,776 | 8/1966 | Morrow | 446/34 |
| 4,708,254 | 11/1987 | Byrns | 220/739 X |
| 4,850,923 | 7/1989 | Etheridge | 446/34 |

*Primary Examiner*—Mickey Yu
*Attorney, Agent, or Firm*—Leon Gilden

[57] ABSTRACT

A toy arranged for projection and flight between individuals to be thrown in a manner such as football, includes a cylindrical body with a conically necked upper end defining resistance in flight of the toy structure. A modification of the invention includes a flap member mounted to the cylindrical body entrance opening to alter flight of the apparatus in use. Further, weighted members are selectively mounted to the flap to provide an imbalance and a wobble in the flight of the apparatus. A "S" clip is also provided for conveniently carrying the cylindrical throwing apparatus on a person.

2 Claims, 4 Drawing Sheets

THROWING TOY

BACKGROUND OF THE INVENTION

1. Field of the Invention

The field of invention relates to throwing toys, and more particularly pertains to a new and improved throwing toy wherein the same is arranged for flight between individuals manually directed between the individuals.

2. Description of Prior Art

Throwing toys of various types are utilized in the prior art for entertainment and amusement purposes. Such toys are typically utilized in game scenario to replicate sporting events such as football. Throwing toys of the prior art are exemplified in U.S. Pat. No. 2,304,215 to Streubel setting forth a wing wheel formed with various openings therethrough for throwing between individuals, wherein flap portions are movable between adjacent members to alter opening of the toy structure.

U.S. Pat. No. 4,261,135 to Lehman sets forth a finger saucer toy wherein the same is arranged for mounting to an individual's hand and for projection therefrom.

U.S. Pat. No. 4,210,009 to Burridge, Jr. sets forth a strobe amusement device replicating a hat structure.

As such, it may be appreciated that there continues to be a need for a new and improved throwing toy as set forth by the instant invention which addresses both the problems of ease of use as well as effectiveness in construction in effecting entertainment and amusement between individuals participating in a game event and in this respect, the present invention substantially fulfills this need.

SUMMARY OF THE INVENTION

In view of the foregoing disadvantages inherent in the known types of throwing toy apparatus now present in the prior art, the present invention provides a throwing toy wherein the same is arranged for projection between individuals in a football-like flight of path. As such, the general purpose of the present invention, which will be described subsequently in greater detail, is to provide a new and improved throwing toy which has all the advantages of the prior art throwing toys and none of the disadvantages.

To attain this, the present invention provides a toy arranged for projection and flight between individuals to be thrown in a manner such as football, including a cylindrical body with a conically necked upper end defining resistance in flight of the toy structure. A modification of the invention includes a flap member mounted to the cylindrical body entrance opening to alter flight of the apparatus in use. Further, weighted members are selectively mounted to the flap to provide an imbalance and a wobble in the flight of the apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved throwing toy which has all the advantages of the prior art throwing toys and none of the disadvantages.

It is another object of the present invention to provide a new and improved throwing toy which may be easily and efficiently manufactured and marketed.

It is a further object of the present invention to provide a new and improved throwing toy which is of a durable and reliable construction.

An even further object of the present invention is to provide a new and improved throwing toy which is susceptible of a low cost of manufacture with regard to both materials and labor, and which accordingly is then susceptible of low prices of sale to the consuming public, thereby making such throwing toys economically available to the buying public.

Still yet another object of the present invention is to provide a new and improved throwing toy which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
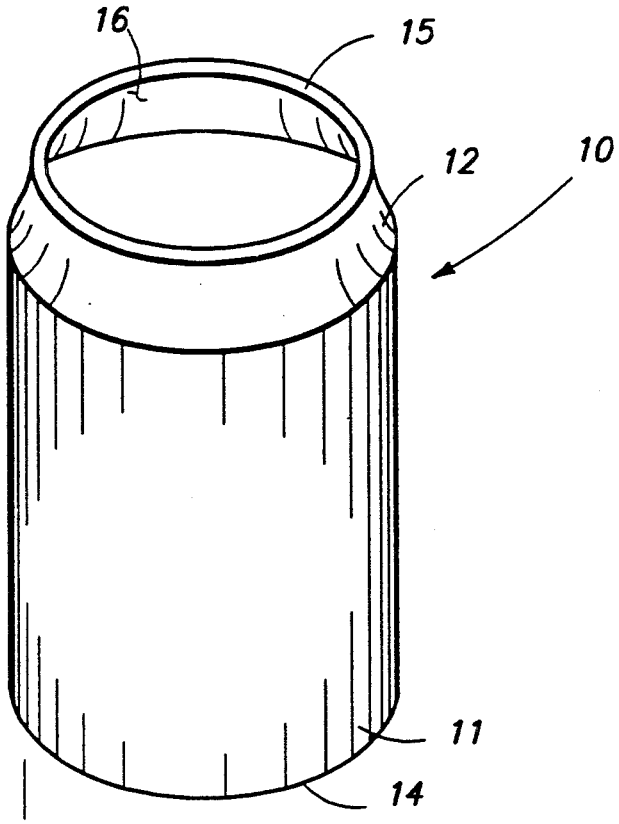
FIG. 1 is an isometric illustration of the instant invention.
Figure 2:
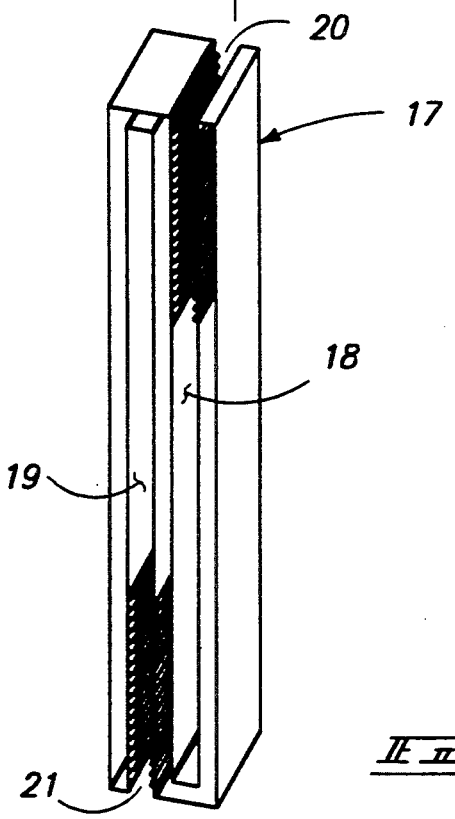
FIG. 2 is an isometric illustration of a clip structure utilized for mounting and transport of an individual to a garment when not in use.
Figure 3:
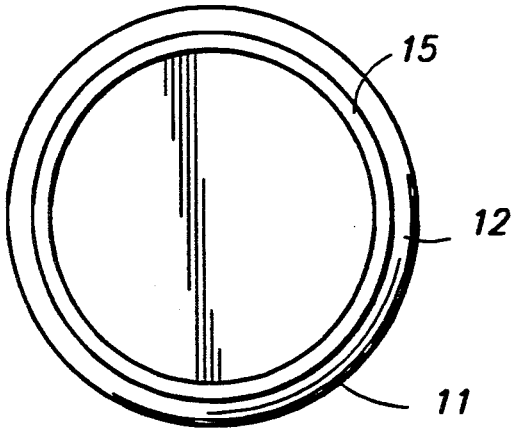
FIG. 3 is an orthographic top view of the instant invention.
Figure 4:
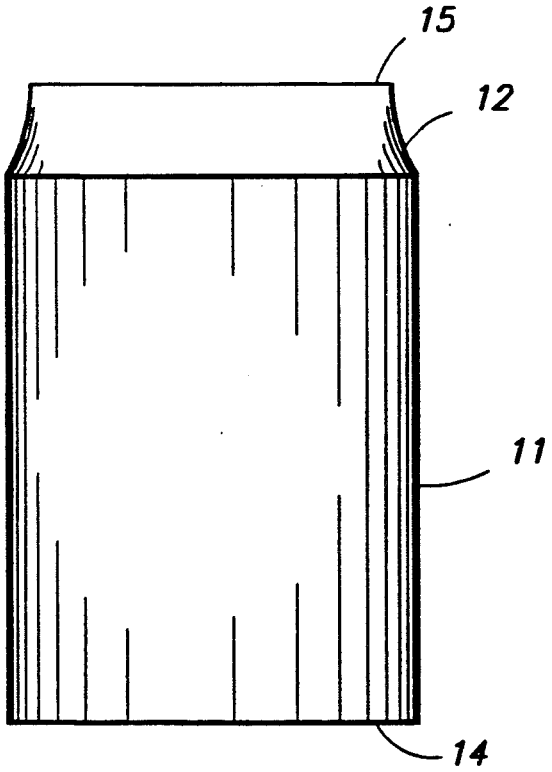
FIG. 4 is an orthographic side view, taken in elevation, of the invention.
Figure 5:
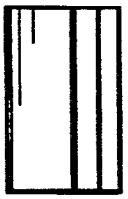
FIG. 5 is an orthographic top view of the clip structure.
Figure 6:
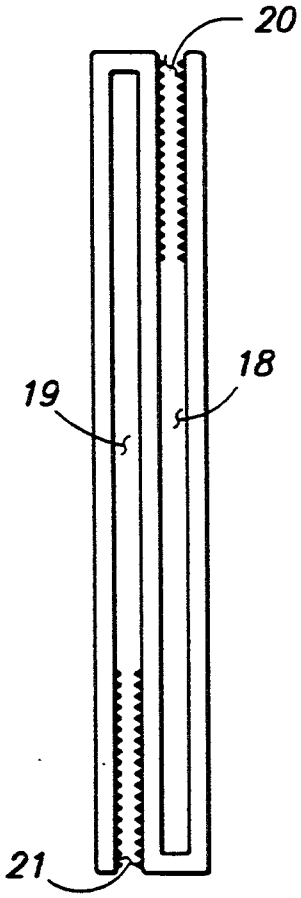
FIG. 6 is an orthographic side view of the clip structure.
Figure 7:
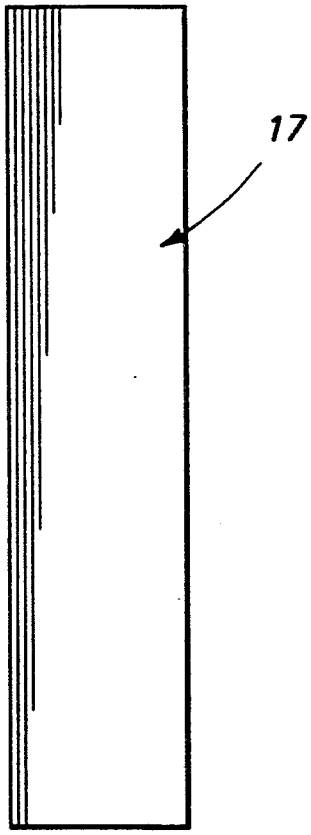
FIG. 7 is an orthographic end view of the clip structure.

With reference now to the drawings, and in particular to FIGS. 1 to 8 thereof, a new and improved throwing toy embodying the principles and concepts of the present invention and generally designated by the reference numeral 10 will be described.

More specifically, the throwing toy of the instant invention essentially comprises a fixed body formed of a generally rigid material, but may also alternatively be formed of a memory retentent flexible structure defining a shape retentive configuration to include a cylindrical body 11, including a conical neck portion 12 fixedly and integrally mounted to an upper terminal end of the cylindrical body, wherein the cylindrical body includes a cylindrical body entrance opening 13 defined as cylindrical body lower terminal end 14. A conical neck upper terminal end 15 includes a neck opening 16, wherein the neck opening defines a neck opening diameter less than a cylindrical body diameter defined by the cylindrical body and the entrance opening 13.

A generally "S" shaped mounting clip 17 is provided that includes a first slot spaced from and parallel a second slot between adjacent parallel plates. A first slot opening 20 includes spaces ribbed resilient first webs to enhance securement of the first slot to the cylindrical body, wherein a second slot opening 21, and the lower terminal end of the clip 17 relative to the upper terminal end, including the first opening defining a second opening with spaced ribbed resilient second webs 21 for frictionally engaging a garment for transport of the body structure.

Figure 8:
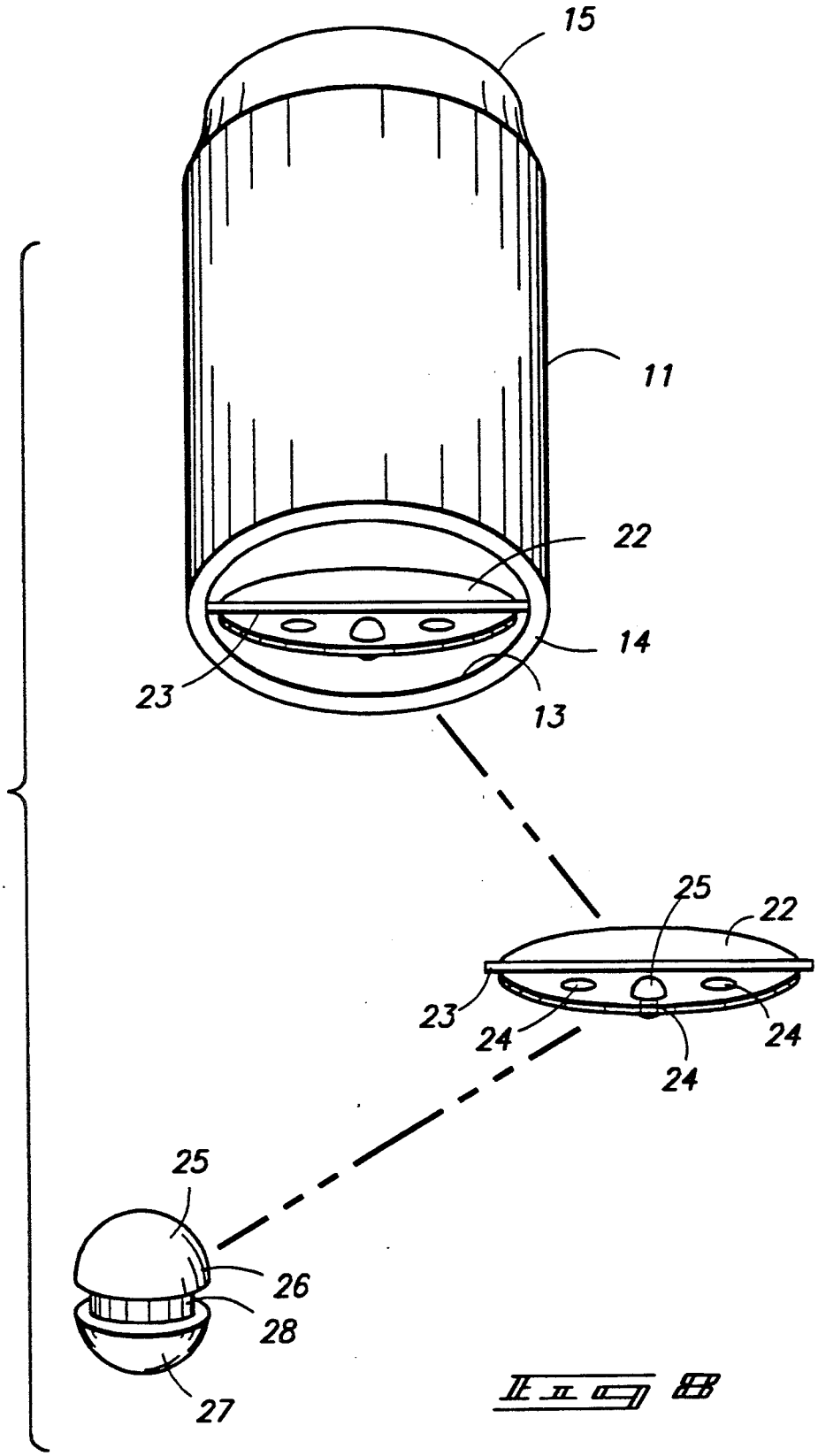
FIG. 8 is an isometric illustration of a flap structure utilized by the throwing toy body.

The cylindrical body 11, as illustrated in FIG. 8, includes an air directing flap 22 defining a cylindrical body entrance opening diameter, including an axle 23 diametrically mounted within the cylindrical body lower terminal end 14. The air directing flap 22 includes a plurality of mounting bores 24 directed through the flap defined by a first diameter formed to a first side portion of the flap defining a semi-cylindrical portion of the flap receiving the mounting bores, wherein weighted plugs 25 are selectively directed into the mounting bores as required to effect imbalancing of the structure creating a wobble in flight. The flap its associated axle 23 is frictionally engaged within the cylindrical body entrance opening 13 to maintain the flap in a desired angular orientation relative to the entrance opening to control air directed through the cylindrical body 11. The weighted plugs 25 each include a central shank 28 equal to the first diameter to be received within a mounting bore 24 of the mounting bores, wherein the cylindrical shank 28 includes an upper semi-cylindrical cap 26 and a lower semi-cylindrical cap mounted to the central shank 28 on opposed sides of the mounting flap and thereby permitting securement or disassembly of the weighted plug 25 as desired to create whatever imbalances desired to add an element of uncertainty in the trajectory of flight during throwing of the toy 10.

It should be further noted that the apparatus 10 may be formed of a single web cut from a single blank and thereafter rotated into the body configuration, wherein the ends of the web are adhered in a manner known in the prior art.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A throwing toy, comprising, a cylindrical body, the cylindrical body including a conical neck portion, the cylindrical body including a cylindrical body entrance opening defined at a cylindrical body lower terminal end, with the conical neck portion including a conical neck upper terminal end defining a neck opening, the neck opening degfined by a neck diameter less than a body diameter defined by the cylindrical body, wherein the cylindrical body entrance opening and the neck opening are coaxially aligned relative to one another, and an "S" shaped mounting clip for transport of the cylindrical body, wherein the clip includes a plurality of spaced parallel plates defining a first slot spaced from the parallel a second slot, the first slot includes a first slot opening directed through an upper terminal end of the "S" shaped mounting clip, wherein the first slot opening includes a plurality of spaced ribbed resilient first webs for frictional engagement with the cylindrical body, and the "S" shaped mounting clip including a second slot directed through a lower terminal end of the "S" shaped mounting clip, wherein the second slot opening includes a plurality of spaced ribbed resilient second webs for securement of the second slot within the garment of an individual, and an air directing flap mounted within the cylindrical body entrance opening, the air directing flap defined by a flap diameter equal to the cylindrical body diameter, and the air directing flap including a flap axle diametrically mounted within the cylindrical body entrance opening at the cylindrical body lower terminal end, and the axle frictionally secured within the cylindrical boy lower terminal end to maintain the air directing flap in a predetermined angular orientation relative to the cylindrical body entrance opening.

2. A toy as set forth in claim 1 wherein the axle divides the flap into a first and second semi-cylindrical portion, wherein the first semi-cylindrical portion includes a plurality of mounting bores defined by a first diameter, and each mounting bore of the mounting bores includes a weighted plug member selectively mounted within each of said mounting bores, and each weighted plug includes a central shank defined by a shank diameter equal to the first diameter and directed within each mounting bore of said mounting bores, and the central shank including an upper semi-cylindrical cap mounted to the central shank at an upper terminal end of the central shank, and a lower semi-cylindrical cap mounted to the central shank at a lower terminal end of the central shank to capture the air directing flap therebetween.

* * * * *